United States Patent [19]

Ozawa et al.

[11] Patent Number: 4,779,861

[45] Date of Patent: Oct. 25, 1988

[54] SHEET SEPARATOR/FEEDER

[75] Inventors: Masahito Ozawa; Masao Goto, both of Tokyo, Japan

[73] Assignee: Oki Electric Industry Co., Ltd., Tokyo, Japan

[21] Appl. No.: 103,825

[22] Filed: Oct. 2, 1987

[30] Foreign Application Priority Data

Oct. 7, 1986 [JP] Japan ..... 61-237089

[51] Int. Cl.[4] ..... B65H 3/06

[52] U.S. Cl. ..... 271/119; 271/122; 271/242; 271/245

[58] Field of Search ..... 271/110, 111, 119, 121, 271/122, 125, 226, 242, 245

[56] References Cited

U.S. PATENT DOCUMENTS 3,857,559 12/1974 McInerny ..... 271/122

4,496,145 1/1985 Fukui ..... 271/122

*Primary Examiner*—Richard A. Schacher

*Attorney, Agent, or Firm*—Wenderoth, Lind & Ponack

[57] ABSTRACT

The leading ends of sheets in a storage container are brought into abutment against arcuate portions of stopper rollers by an abutment roller to orient the sheets properly with respect to the first direction, i.e, to correct the sheets out of a skewed condition Then, the sheets are fed between a feed roller and a separator roller to arrow the separator roller to separate the uppermost sheet from the other sheets. Thereafter the other sheets are fed back into the storage container by reverse rollers.

4 Claims, 5 Drawing Sheets

SHEET SEPARATOR/FEEDER

BACKGROUND OF THE INVENTION

The present invention relates to a sheet separator/-feeder for use in an automatic money depositing/dispensing machine, an optical reader, or the like, and more particularly to a sheet separator/feeder having a plurality of rollers of different types rotatable for separating an feeding sheets of paper such as bills, manuscripts, or blank forms, one by one, from a storage unit in different directions of feed.

Conventional sheet separator/feeders have proven unsatisfactory in that sheets as they are fed out tend to be skewed with respect to the direction of feed, and skewed sheets may cause a jam or other troubles that obstruct subsequent processing of the sheets.

SUMMARY OF THE INVENTION

It is an object of the present invention to provide a sheet separator/feeder capable of separating and feeding sheets without skewing them.

According to the present invention, there is provided a sheet feeder/separator comprising a storage container having a vertically movable stage for supporting a stack of sheets, pickup rollers for pressing contact with an uppermost sheet of the stack of sheets, a feed roller for feeding the uppermost sheet out of the storage container, the pickup and feed rollers being rotatable in a first direction to feed sheets out of the storage container, a separator roller disposed below the feed roller and rotatable in a second direction to feed back sheets into the storage container, reverse rollers disposed coaxially with and one on each side of the separator roller, stopper rollers disposed coaxially with and outwardly of the reverse rollers, each of the stopper rollers having an arcutate portion, tension rollers disposed coaxially with and one on each side of the feed roller in coaction with the reverse rollers, respectively, gate rollers disposed coaxially with an outwardly of the tension rollers in mesh with the arcuate portions of the stopper rollers, respectively, and an abutment roller disposed coaxially with the pickup rollers. The leading ends of sheets in the storage container are brought into abutment against the arcuate portions of the stopper rollers by the abutment roller to orient the sheets properly with respect to the first direction. Then, the sheets are fed between the feed roller and the separator roller to allow the separator roller to separate the uppermost sheet from the other sheets. Thereafter the other sheets are fed back into the storage container by the reverse rollers.

With the above arrangement, sheets as they are fed out of the storage container can be corrected out of a skewed condition and can be separated and fed one by one from the storage container. Therefore, undesired paper jams or other troubles can be prevented from occurring, and the sheets fed from the storage container can subsequently be processed smoothly.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
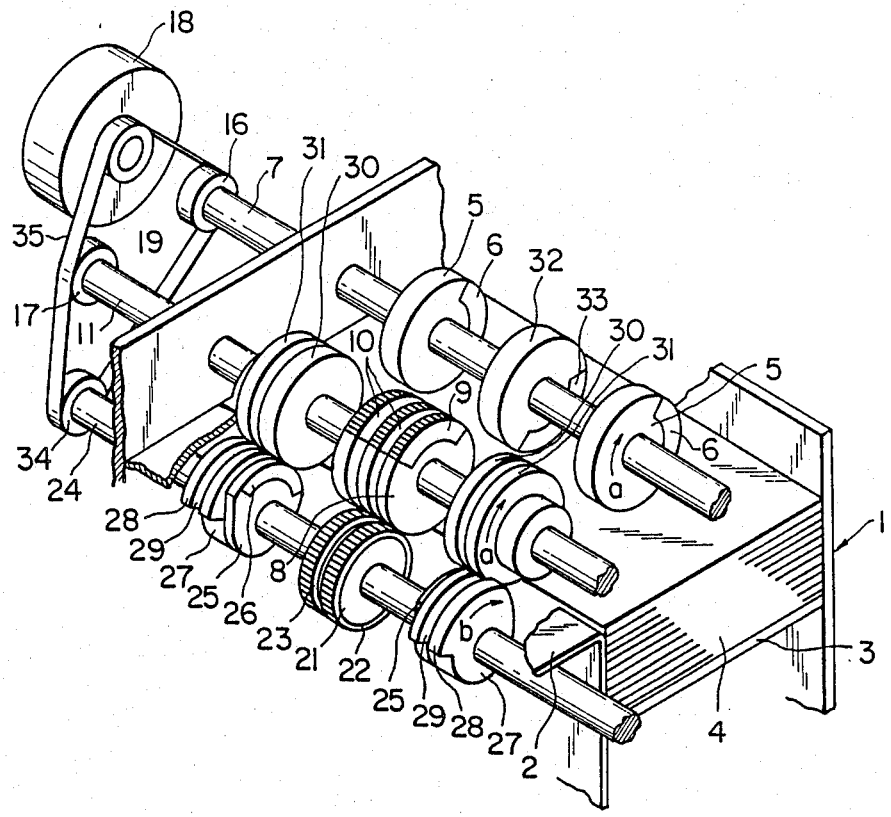
FIG. 1 is a perspective view of a sheet separator/-feeder according to the present invention.

As shown in FIG. 1, a sheet separator/feeder according to the present invention has a storage container 1 including a horizontal guide plate 2 on its front end and a bottom plate or stage 3 which is vertically movable. A stack of sheets 4 such as bills, manuscripts, blank forms, or the like is placed on the stage 3 and accommodated in the storage container 1.

The sheet separator/feeder has two pickup rollers 5 mounted on a shaft 7 at axially spaced intervals and placed on the sheet stack 4. Each of the pickup rollers 5 has an arcuate frictional member 6 disposed partly in an outer circumferential surface thereof, the arcuate member 6 being of a high coefficient of friction.

A feed roller 8 is mounted on a shaft 11 and positioned over the guide plate 2 centrally in the longitudinal direction of the sheet stack 4 on the stage 3. The feed roller 8 has an arcuate frictional member 9 disposed partly in an outer circumferential surface thereof, the arcuate member 9 being of a high coefficient of friction. The feed roller 8 also has two parallel spaced annular grooves 10 defined in its entire outer circumferential surface.

Pulleys 16, 17 are mounted on ends of the shafts 7, 11, respectively. An electric motor 18 has a driver pulley 19 mounted on the rotatable output shaft thereof.

The stage 3 of the storage container 1 is normally urged upwardly by a spring or a driver mechanism (not shown) to keep the uppermost sheet 4 pressed against the pickup rollers 5. The frictional members 6, 9 have frictional forces large enough to feed out the sheets 4 in contact therewith.

A separator roller 21 has a frictional member 22 extending over the entire outer circumferential surface thereof and having frictional forces large enough to feed out the sheets 4 in contact therewith. The separator roller 21 has an annular groove 23 defined in its entire circumference.

The separator roller 21 is fixed to a shaft 24 disposed below the guide plate 2 and extending downwardly of the shaft 11 parallel thereto. The separator roller 21 has an outer circumferential portion projecting beyond the upper surface of the guide plate 2 through hole defined therein. The feed roller 8 and the separator roller 21 are combined with each other, but held out of contact with each other, in the same plane, such that the annular lands defined by the annular grooves 10, 23 of the rollers 8, 21 are held in interfitting relation.

Two reverse rollers 25 are fixed to the shaft 24 one on each side of the separator roller 21 in spaced relation thereto. Each of the reverse rollers 25 has an outer circumferential portion having the same diameter as that of the separator roller 21 with the other outer circumferential portion being of a smaller diameter. The outer circumferential portion of the same diameter as that of the separator roller 21 has a frictional member 26 of a high coefficient of friction having a frictional force large enough to feed back sheets 4 into the storage container 1.

Two stopper rollers 27 are fixed to the shaft 24 outwardly of the reverse rollers 25, respectively. Each of the stopper rollers 27 is in the form of a cam having an arcuate portion 28 of a slightly larger diameter than the outside diameter of the separator roller 21. The arcuate portion 28 has a circumferential groove 29 defined therein.

The arcuate portions 28 of the stopper rollers 27 and the portions of the reverse rollers 25 which have the frictional members 26 project beyond the upper surface of the guide plate 2 through holes defined therein.

Two tension rollers 30 are fixed to the shaft 11 one on each side of the feed roller 8 in spaced relation thereto, and two gate rollers 31 are fixed to the shaft 11 outwardly of the tension rollers 30, respectively, in spaced relation thereto. These tension and gate rollers 30, 31 are of the same diameter as that of the feed roller 8. The tension rollers 30 are held in contact with the frictional members 26 of the reverse rollers 25, respectively. The gate rollers 31 are held in mesh with the stopper rollers 27 for a certain extent through the grooves 29.

An abutment roller 32 having the same diameter as that of the pickup rollers 5 is fixed to the shaft 7 at a position between the two pickup rollers 5. The abutment roller 32 has an outer circumferential portion having a frictional member 33 having a frictional force sufficiently large to feed out the sheet 4, but small enough to slip against the sheet 4 when the opposite ends of the sheet 4 abut against the ends of the arcuate portions 28 of the stopper rollers 27.

A pulley 34 is mounted on one end of the shaft 24. An endless belt 35 is trained around the pulleys, 16, 17, 34 and the driver pulley 19. When the motor 18 is energized to rotate its output shaft, its rotative force is transmitted through the driver pulley 19 and the belt 35 to the pulleys 16, 17, 34. Therefore, the pickup rollers 5 and the abutment roller 32 on the shaft 17, the feed roller 8, the tension rollers 30, and the gate rollers 31 on the shaft 11, and the separator roller 21, the reverse rollers 25, and the stopper rollers 27 on the shaft 24 are rotated with these shafts 17, 11, 24.

The pickup rollers 5, the abutment roller 32, the feed roller 8, the tension rollers 30, and the gate rollers 31, which are held against the face of the sheet 4 are rotated in the direction of the arrow a to feed out the sheet 4 from the storage container 1. The separator roller 21, the reverse rollers 25, and the stopper rollers 27, which are held against the back of the sheet 4 are rotated in the direction of the arrow b to feed back the sheet 4 into the storage container 1.

The frictional members 6 of the pickup rollers 5 and the frictional member 33 of the abutment roller 32 are angularly positioned relatively to each other such that the frictional members 6 contact a sheet 4 later than the frictional member 33 does. The frictional members 26 of the reverse rollers 25 and the arcuate portions 28 of the stopper rollers 27 are angularly displaced substantially 90° from each other.

Figure 4:
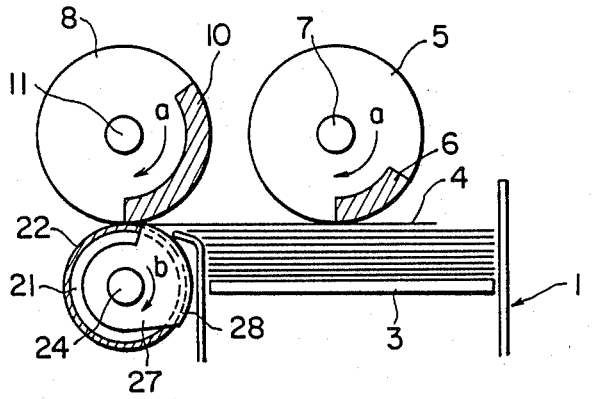
FIG. 4 is a side elevational view of the sheet separator/feeder of FIG. 1, showing the manner in which a sheet is fed out.
Figure 5:
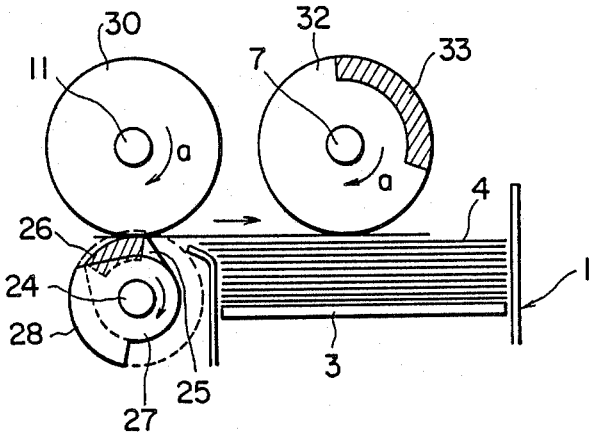
FIG. 5 is a side elevational view of the sheet separator/feeder of FIG. 1, showing the manner in which a sheet is reversed.
Figure 6:
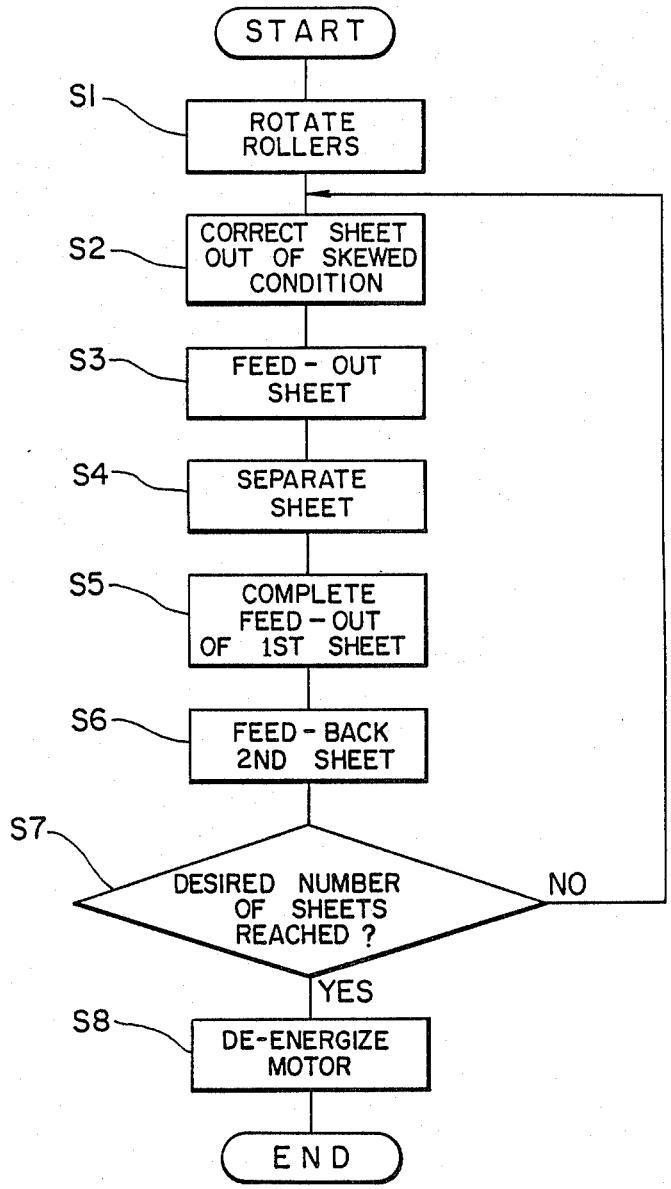
FIG. 6 is a flowchart of an operation sequence of the sheet separator/feeder.

Operation of the sheet separator/feeder thus constructed will be described with reference to FIGS. 2 through 7 according to the steps of an operation sequence shown in FIG. 6.

Step 1: The motor 18 is rotated in response to a signal from a control unit (not shown) while the uppermost sheet 4 of the stack on the stage 3 is being held against the pickup rollers 5 and the abutment roller 32. As described above, the rotative force of the motor 18 is transmitted through the driver pulley 19 and the belt 35 to the pulleys 16, 17, 34. Therefore, the pickup rollers 5 and the abutment roller 32 on the shaft 17, the feed roller 8, the tenion rollers 30, and the gate rollers 31 on the shaft 11 are rotated in the direction of the arrow a, and the separator roller 21, the reverse rollers 25, and the stopper rollers 27 on the shaft 24 are rotated in the direction of the arrow b.

Figure 2:
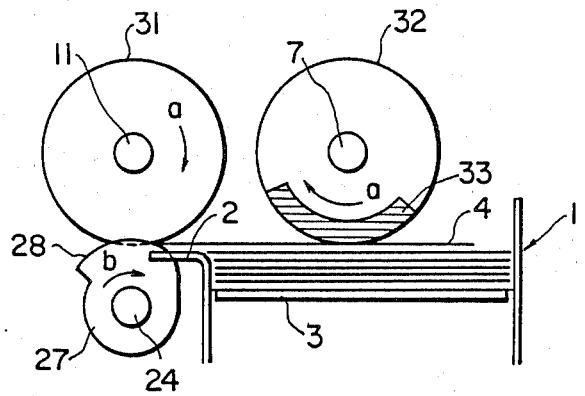
FIG. 2 is a side elevational view of the sheet separator/feeder showing the manner in which a sheet is corrected out of a skewed condition.
Figure 3:
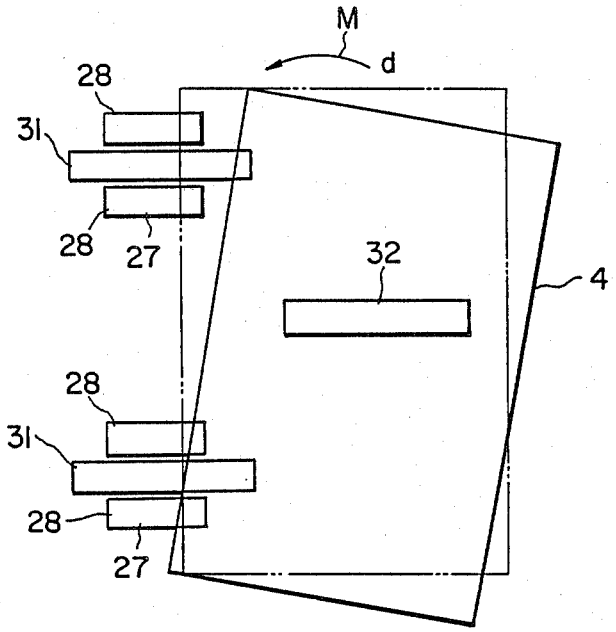
FIG. 3 is a plan view of the arrangement shown in FIG. 2.
Figure 7:
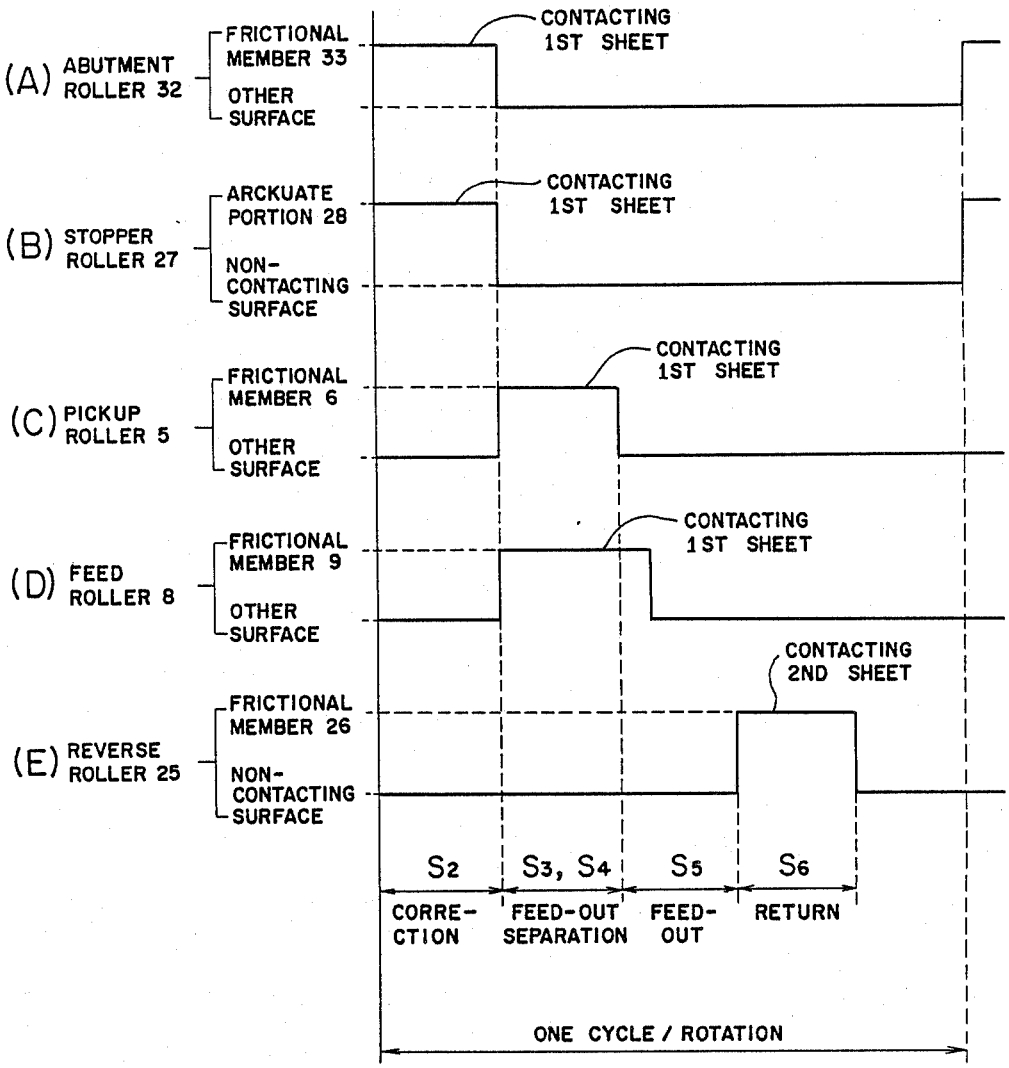
FIG. 7 is a timing chart of operation of various rollers of the sheet separator/feeder illustrated in FIG. 1.

Step 2: The frictional member 33 of the abutment roller 32 is brought into contact with the uppermost sheet 4, as shown in FIG. 7 at (A). As the abutment roller 32 rotates, the uppermost sheet 4 is fed out forwardly by the frictional member 33, as shown in FIG. 2. At this time, the arcuate portions 28 of the stopper rollers 27 are in mesh with the gate rollers 31, and hence the leading end of the sheet 4 fed out by the frictional member 33 abuts against the arcuate portions 28 of the stopper rollers 27, as shown in FIG. 7 at (B). If the sheet 4 is skewed with respect to the direction of feed as shown in FIG. 3, one side of the leading end of the sheet 4 is first engaged by the arcuate portion 28 of one of the stopper rollers 27. Upon continued rotation of the abutment roller 32, the sheet 4 is turned in the direction of the arrow d (FIG. 3) by the frictional members 6 until the other side of the leading end of the sheet 4 abuts against the arcuate portion 28 of the othe stopper roller 27. The sheet 4 is thus corrected out of the screwed condition as indicated by the dot-and dash lines in FIG. 3, and hence is properly oriented. During this correcting process, the gate rollers 31 prevent the leading end of the sheet 4 from being lifted and press the same against the arcuate portions 28.

Step 3: While the sheet 4 is being corrected out of the skewed condition,the stopper rollers 27 rotate to bring the arcuate portions 28 thereof out of mesh with the gate rollers 31. Then, as shown in FIGS. 4 and 7 at (C), the frictional members 6 of the pickup rollers 5 contact the sheet 4 and feed the sheet out of the storage container 1 in response to continued rotation of the pickup rollers 5.

Step 4: The leading end of the sheet 4 is brought into contact with the frictional member 9 of the feed roller 8, as shown in FIG. 7 at (D), while being sandwiched between the frictional member 9 and the frictional member 22 of the separator roller 21. Further rotation of the feed roller 8 feeds out the sheet 4 along the guide plate 2. At this time, the separator roller 21 rotates in the direction to feed back the sheet 4 into the storage container 1. The frictional force of the frictional member 22 of the separator roller 21 is smaller than the frictional force of the frictional member 9 of the feed roller 8. Therefore, if only one sheet 4 is fed out by the pickup rollers 5, then the sheet 4 is smoothly fed out along the guide plate 2 by the frictional member 9. If two sheets 4 are fed out by the pickup rollers 5, then only the first, or uppermost sheet 4 held in direct contact with the frictional member 9 is fed out along the guide plate 2, whereas the second sheet 4 below the first sheet 4 is separated from the first sheet 4 by the separator roller 21.

Step 5: Therefore, only the uppermost sheet 4 is separated and fed out by the feed roller 8.

Step 6: After the uppermost sheet 4 has been fed completely out of the storage container 1, the second sheet 4 which may be present between the feed roller 8 and the separator roller 21 is sandwiched between the frictional members 26 of the reverse rollers 25 and the tension rollers 30. The frictional members 26 are then brought into contact with the sheet 4, as shown in FIG. 7 at (E), and thereafter the sheet 4 is fed back into the storage container 1 by the frictional members 26, 22 upon rotation of the reverse rollers 25 and the separator roller 21, as shown in FIG. 5. At this time, the tension rollers 30 rotate in the direction to feed out the sheet 4 in cooperation with the feed roller 8 and the gate rollers 31, and the pickup rollers 5 and the abutment roller 32 rotate also in the same direction. However, the frictional forces imposed by the tension rollers 30 on the sheet 4 are smaller than those of the frictional members 26 of the reverse rollers 25, and the frictional members 9, 6, 33 of the feed rollers 8, the pickup rollers 5, and the abutment roller 32 have already passed out of contact with the sheet 4. Therefore, the sheet 4 is smoothly pushed back into the storage container 1.

One sheet 4 is separated and fed out in the above manner. If a plurality of sheets 4 are to be fed out successively, the following steps will be additionally executed:

Step 7: The step 7 ascertains whether the number of sheets 4 fed out of the storage container 4 has reached a desired number or not. This can be achieved, for example, by employing a sensor for detecting each time a sheet 4 is fed out, counting the number of sheets 4 fed out based on the output signal from the sensor (not shown), and ascertaining, in the control unit, whether the desired number of sheets has been fed out or not. If the desired number of sheets 4 is not reached, then the process after the steps 2 is repeated.

Step 8: When the number of sheets 4 fed out of the storage container 1 reaches the desired number, the motor 18 is de-energized to stop the rotation of the various rollers. Thus, the sheet separating and feeding process is completed.

Although a certain preferred embodiment has been shown and described, it should be understood that many changes and modifications may be made therein without departing from the scope of the appended claims.

What is claimed is:

1. A sheet feeder/separator comprising:

a storage container having a vertically movable stage for supporting a stack of sheets;

pickup rollers for pressing contact with an uppermost sheet of said stack of sheets;

a feed roller for feeding the uppermost sheet out of said storage container, said pickup and feed rollers being rotatable in a first direction to feed sheets out of said storage container;

a separator roller disposed below said feed roller and rotatable in a second direction to feed back sheets into said storage container;

reverse rollers disposed coaxially with and one on each side of said separator roller;

stopper rollers disposed coaxially with and outwardly of said reverse rollers, each of said stopper rollers having an arcutate portion;

tension rollers disposed coaxially with and one on each side of said feed roller in coaction with said reverse rollers, respectively;

gate rollers disposed coaxially with and outwardly of said tension rollers in mesh with said arcuate portions of said stopper rollers, respectively;

an abutment roller disposed coaxially with said pickup rollers; and the arrangement being such that the leading ends of sheets in said storage container are brought into abutment against the arcuate portions of said stopper rollers by said abutment roller to orient said sheets properly with respect to said first direction, then the sheets are fed between said feed roller and said separator roller to allow said separator roller to separate the uppermost sheet from the other sheets, and thereafter said other sheets are fed back into said storage container by said reverse rollers.

2. A sheet separator/feeder according to claim 1, further including a shaft, said abutment roller and said pickup rollers being mounted on said shaft, said abutment roller being disposed between said pickup rollers.

3. A sheet separator/feeder according to claim 1, further including a shaft, said feed roller, said tension rollers, and said gate rollers being mounted on said shaft.

4. A sheet separator/feeder according to claim 1, further including a shaft, said separator roller, said reverse rollers, and said stopper rollers being mounted on said shaft.

* * * * *